US006189632B1

(12) United States Patent
Warden

(10) Patent No.: US 6,189,632 B1
(45) Date of Patent: Feb. 20, 2001

(54) MACHINED DRILL STEEL

(76) Inventor: Brian E. Warden, Rt. 2, Box 449, Del Barton, WV (US) 25670

( * ) Notice: Under 35 U.S.C. 154(b), the term of this patent shall be extended for 0 days.

(21) Appl. No.: 09/097,954

(22) Filed: Jun. 16, 1998

Related U.S. Application Data

(60) Provisional application No. 60/049,646, filed on Jun. 16, 1997.

(51) Int. Cl.[7] ..... E21B 17/00
(52) U.S. Cl. ..... 175/320; 403/383
(58) Field of Search ..... 175/320; 403/383, 403/359.6, 305

(56) References Cited

U.S. PATENT DOCUMENTS

| | | | | |
|---|---|---|---|---|
| 3,138,216 | * | 6/1964 | Heiskanen et al. | 175/320 |
| 3,554,306 | * | 1/1971 | Wilburn | 175/320 |
| 3,966,341 | | 6/1976 | Bailey et al. . | |
| 4,009,760 | | 3/1977 | Hansen et al. . | |
| 4,099,585 | | 7/1978 | Emmerich . | |
| 4,206,821 | | 6/1980 | Emmerich . | |
| 4,299,510 | | 11/1981 | Emmerich et al. . | |
| 4,453,854 | | 6/1984 | Emmerich . | |
| 4,474,488 | * | 10/1984 | Pinkerton et al. | 403/24 |
| 4,615,402 | | 10/1986 | Eisenloeffel . | |
| 4,632,195 | | 12/1986 | Emmerich . | |
| 4,745,983 | | 5/1988 | Moorehead et al. . | |
| 4,773,490 | | 9/1988 | McSweeney et al. . | |
| 4,907,660 | | 3/1990 | Staggs et al. . | |
| 5,337,842 | * | 8/1994 | Robinson | 175/323 |
| 5,417,475 | | 5/1995 | Graham et al. . | |

FOREIGN PATENT DOCUMENTS 159777 11/1962 (SU) .

OTHER PUBLICATIONS

Clark, Daniel, Production and Metallurgical Characteristics of Hollow Mining Drill Steel in Australia, *Australian Institute of Mining & Metallurgy*, Mar. 31–Jun. 30, 1947, pp. 205–233.

*Mining Equipment, Parts and Accessories and Supplies Market*, Frost & Sullivan, Inc., Feb. 1979.

Marais, Jacobus Johannes, *Stresses in Drill Steels Leading to Fatigue Failure*, University of Pretoria, DAI, vol. 42–06B, 1980, p. 2477.

Nilsson, Roland, *Drill Steel Equipment in Modern Mining*, Mining Equipment International, vol. 6, No. 6, Jun. 1982.

* cited by examiner

*Primary Examiner*—William Neuder
(74) *Attorney, Agent, or Firm*—Snell & Wilmer, L.L.P.

(57) ABSTRACT

The present invention provides drill steel members for a roof drilling system used in the mining industry. A drill steel member suitably comprises a steel tube body having at least one machined end integral to the body and having an external shape configured for coupling to a component part. The component part preferably has an aperture formed therein having an internal shape corresponding to the external shape of the machined end of the body. In a preferred embodiment, the component part is coupled to the machined end by a press-fitting engagement. Preferably, the machining of the end of the body and the press-fitting engagement are performed in the absence of externally applied heat. The machined ends, along with the press-fitting assembly technique, results in a drill steel member that has a longer life span than conventional welded for forged members.

6 Claims, 8 Drawing Sheets

MACHINED DRILL STEEL

CROSS-REFERENCE TO RELATED APPLICATION

This application is based upon and claims priority of United States Provisional Application, Serial No. 60/049,646, filed Jun. 16, 1997.

TECHNICAL FIELD

The present invention relates, generally, to drill steel, and more particularly to drill steel members used with conventional drilling machines to drill holes in the roof of a mine for the insertion of roof bolts.

BACKGROUND OF THE INVENTION

In the mining industry, it is customary to support the roof of each mine by initially drilling holes in the rock strata in a predetermined pattern, and then installing roof bolts into the newly drilled holes. Today's roof bolts are generally installed into the drilled hole with a resin adhesive and the like to further secure the bolt within the drilled hole. Additionally, these bolts are accompanied by a metal plate that is positioned to support the rock strata to prevent the collapse of the mine roof.

In order to drill holes in the rock strata, a conventional roof drilling machine is utilized. Typically, these drilling machines include a drive end and utilize drill steel members and a carbide insert or drill bit, generally 1" in diameter, attached to one end of the final drill steel member to drill the holes in the mine roof. These drill steel members are generally coupled on the other end, e.g. the drive end, by a chuck located on the drilling machine. This attachment provides a means for rotating the drill member and thus the drill bit to remove material and debris from the drilled hole. To facilitate the removal of material and debris from the drilled hole, many drilling machines incorporate a vacuum suction collection system wherein the drill steel member is constructed from a hollow steel bar, the drill bit is configured to remove debris via a passageway located within the bit, and the vacuum system collects the debris as it is passed through the passageway of the drill bit and the hollow drill steel member during drilling of the rock strata.

In mines having relatively high seams of minerals, such as coal, the drill steel members are designed and manufactured to a sufficient length for drilling the desired depth, generally three to six feet, without the need to replace or extend the drill steel member. However, in low height mines, it becomes necessary to initially drill the hole with a shorter drill steel member, often known as a starter, and then replace the starter with additional sections of drill steel, such as drivers, extensions and finishers, to drill the remaining desired depth of the hole. These additional sections are often joined together by various component parts that generally include a drill bit seat, a male and a female connector, and a drive end component. These components are typically attached or configured to the ends of the drill steel members or sections by various methods discussed below.

In accordance with one conventional manufacturing technique, a drill steel section is cut to the desired drilling length for a particular member and then the ends of the section are typically beveled to facilitate welding of a component part onto the corresponding end of the drill steel section. The individual components are initially cast or otherwise fabricated by various well-known processes and then welded directly to an appropriate end of the corresponding drill steel section. Although these completed drill steel members, including the starter, driver, extension and finisher, are generally easy to manufacture, many drawbacks for this manufacturing method exist.

First, the effects of heat produced during the welding of components to drill steel sections results in the production of stress fractures, cracks and other residual stresses as a result of the intense heating (welding temperatures can exceed hundreds of degrees of Fahrenheit) and cooling of the steel. These fractures and cracks are produced not at the heat point but typically at the transfer points, or heat-affected zones, located on both sides of the heat point. Additionally, in the current industry, the joining of the components to the drill steel generally requires manual labor to assemble the parts. This assembly process results in variability in alignment of the component parts to the drill sections, and thus in the alignment of one drill steel member, such as a driver, when joined to another drill steel member, such as a finisher. Further, inconsistencies from weld to weld often occur which not only detrimentally affects the quality of the product but also the safety of the product during use. These inconsistencies include, for example, the variability in the type of wire selected, the particular gas utilized, the particular heat settings selected, and the relative experience and ability of the individual welder. As one skilled in the art will appreciates, these variables have a tremendous impact on the overall quality of the welded products and can thus detrimentally affect the performance of those members.

As one skilled in the art will appreciate, the potential for misalignment as well as the production of stress fractures and cracks around the transfer point can lead to a premature failure of one or more of the drill steel members and thus result in unsafe working conditions. An extremely critical aspect of the drilling process is that the drilled hole needs to be truly centered, e.g., as straight as possible, as indicated by a smooth rotation of the drill steel members by the drilling machine. As one skilled in the art will appreciate, this truly centered requirement is even more critical in today's industry due to the operation of drill machines at higher and ever-increasing drilling speeds. Once the drill member is inserted well within the depths of the drilling hole, the opportunity for lateral movement of the drill steel member within the hole is minimal. Since the drilling machine is stationary, any stresses or forces generated by misalignment of the drill steel members will be imparted on the weakest point of the drilling system, e.g., the existing stress fracture or crack or misaligned area, and thus the drill steel member will prematurely fail. Often this failure occurs in the area proximate the drive end of the drilling machine and near the drilling machine operator, an extremely hazardous and unsafe condition. Therefore, as one skilled in the art will appreciate, these problems result in higher production costs due to excessive component usage and equipment downtime Due to these safety hazards, as well as increased operating costs, various other methods have been developed in an attempt to minimize the potential for the production of fractures or cracks and misalignment problems. U.S. Pat. No. 4,299,510, issued to Emmerich et al. on Nov. 10, 1981, generally discloses a two-step process utilizing hot upset forging to eliminate the need for welding the component directly to one end of the drill steel section. U.S. Pat. No. 4,453,854, issued to Emmerich et al. on Jun. 12, 1984, generally discloses a one-hit hot forming process for producing a drill steel member. Other known forging methods, e.g., open and closed die forging and back extrusion forging, can be utilized for the manufacturing of drill steel members. When utilizing one of the above methods, generally, a manufacturer cuts the drill steel section to an appropriate length (the desired drilling length plus the additional length needed for forging the component part). Once cut, the ends of the section are heated to extreme temperatures (which may exceed hundreds of degrees Fahrenheit) and then placed into a forging press, wherein the component part is pounded out from the hot material. The advantages of these forging processes include cheaper manufacturing costs due to the processing of the component parts directly from the heated ends of the drill steel sections as well as the use of automation in the forging process. As a result of a reduction in the opportunities for misalignment of component parts, forged drill steel members have been known to outperform the life span of welded drill steel members by a factor of 2 to 3 times longer.

However, various disadvantages also exist with forged steel products. As discussed above, the component parts are formed from the heating and shaping of the steel sections. Forging heat, as one skilled in the art will appreciate, is a wider-spread heat than that applied from welding processes, and is generally significantly hotter than the welding process, such that larger heat-affected zones can be generated. Additionally, although the component part is created directly within the end section of the drill steel, the tolerances associated with the forging process still provide opportunities for misalignment. Although the misalignment of forging products can be significantly less than that of welded products, the combination of misalignment and the use of extreme heat in the process, which can produce residual stresses or cracks, still leads to premature failures of the drill steel members.

In an attempt to minimize these problems, many manufacturers will utilize a thicker-walled tubing for the drill steel sections and members. The outside diameter of the drill steel members is generally produced to ⅞", due to the necessity during drilling operations to drill holes of a particular diameter to accommodate the standard-sized roof bolts utilized throughout the mining industry. Therefore, in order for manufacturers to obtain a thicker-walled tubing, the inner diameter of the drill steel member must be decreased. This corresponding decrease in the inner diameter of the drill steel member results in a decrease in the efficiency of the vacuum collection system, and thus a decrease in the drilling rate and performance of these prior art drill members.

Yet another drawback of the forging methods described above occurs during the forming of female component parts used for coupling of one drill steel member, such as a starter, to another drill steel member, such as a finisher. As discussed, when using forging methods, typically, an appropriate end of a drill steel section is heated to an extreme temperature and then placed into a forging press to pound out the component part, such as the female component, from the hot material. The pounding out of the component has a tendency to produce a female component with a diameter larger than the ⅞" steel tube utilized, generally approaching 1" in size. Due to the 1" diameter hole being drilled by the carbide drill bit, very little clearance exists between the female component part and the drilled hole. As one skilled in the art will appreciate, this lack of clearance often causes severe dragging on the drill system as a result of friction generated between the rotating component part and the inner walls of the drilled hole. In addition, the friction generated has a tendency to heat up the component parts and further accelerate the deterioration and wear of the drill steel members, thus resulting in premature failures.

Thus, a long felt need exist for an improved drill steel member that provides a longer product life and a significant reduction in premature failures during operation. Furthermore, there exists a long felt need for drill steel members that are not only safer for the mine worker and for the industry but also provide improved drilling performance, such as, for example by providing improved vacuum collection efficiency and improved drill centering and alignment, thus resulting in a more desirable drill steel member.

SUMMARY OF THE INVENTION

Accordingly, it is an advantage of the present invention that an improved method for the manufacturing of drill steel members is provided.

Another advantage of the present invention is that the improved method does not utilize heat to join or configure component parts to the ends of drill steel sections.

Yet another advantage of the present invention is that misalignment problems that are typical with the prior art methods are not realized.

Additionally, stronger, more durable, and reliable drill steel members according to the present invention provide a much safer product for the mining industry.

Still yet another advantage of the present invention is that it provides drill steel members having a larger inner diameter for suction of debris by a vacuum collection system, and thus an improvement to the production process.

BRIEF DESCRIPTION OF THE DRAWING FIGURES

The present invention will hereinafter be described in conjunction with the appended drawing figures, wherein like numeral denote like elements, and:

DETAILED DESCRIPTION OF PREFERRED EXEMPLARY EMBODIMENTS

The present invention dramatically improves the performance of drill steel members through the use of machining processes to facilitate coupling of component parts to the drill steel sections without the use of heat or the problems of misalignment prior art drill steel members. Because of the increased manufacturing costs associated with the direct machining of the drill steel sections (due to the extensive labor required in providing members of a higher precision and lower tolerances), those skilled in the art have deemed any type of machining process to be too cost prohibitive. However, by using the machining methods described below, the life span of machined drill steel members can be six to eight times the life span of welded members and two to three times the life span of forged members. The benefits of these machined methods will now be described in the context of preferred embodiments in accordance with the present invention.

Figure 1A:
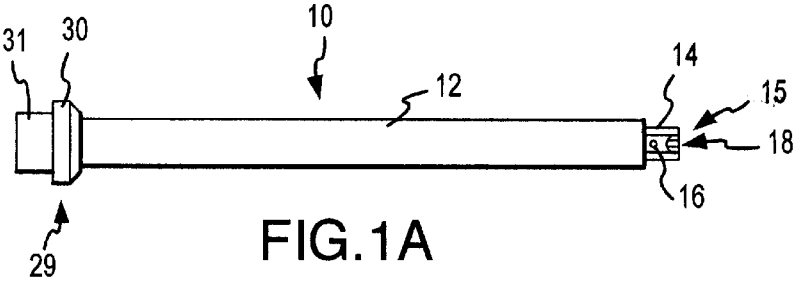
FIG. 1A is a side view of an exemplary embodiment of a starter member in accordance with the present invention.
Figure 1B:
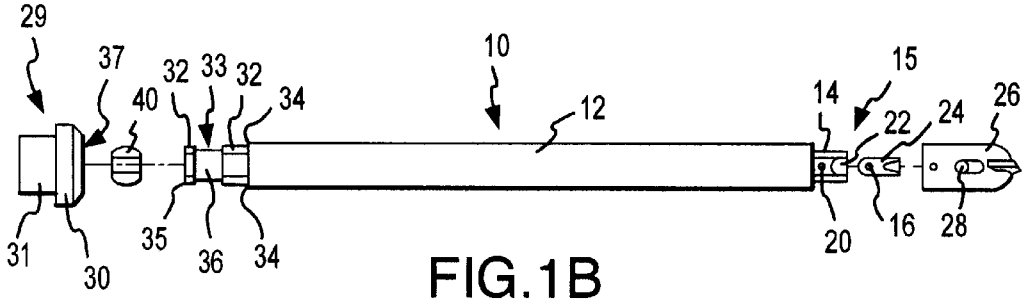
FIG. 1B is an exploded view of the exemplary embodiment shown in FIG. 1A.

Referring now to FIGS. 1A and 1B, a drill steel member 10 suitably includes a body section 12, a first end 33, a second end 15, and a component part 29. In accordance with the present invention, body section 12 comprises a steel tube which contains a passageway through its longitudinal axis to facilitate removal of material and debris from the drilled hole when used with an internal vacuum suction bit. In accordance with a preferred embodiment of the present invention, drill steel tube typically has a uniform outer diameter of ⅞" (0.875"). Due to the strength and durability of the various drill steel members, a wall thickness of approximately 0.189" is utilized in accordance with the preferred exemplary embodiment of the present invention. Accordingly, drill steel members will typically have a uniform inner diameter of approximately 0.50" to provide a passageway for material and debris to be collected and retrieved. Because of the problems due to the prior art methods using welding and forging, prior art steel tube sections require a wall thickness of 0.200"; accordingly, the inner diameter of the prior art steel tubes is typically 0.475", approximately 0.022" smaller than the preferred embodiment of the present invention, and thus the vacuum collection efficiency for steel tubes utilizing welding or forging is less efficient than that of the present invention. In accordance with the preferred embodiment of the present invention, body section 12 is also configurable in various lengths, preferably ranging from 6" in length to 144" in length and most preferably in 6" increments. Although body section 12 is preferably formed from a round tube, it may alternatively have any suitable cross-sectional shape.

In accordance with a preferred exemplary embodiment of the present invention, drill steel member 10 is configured as a starter member. In accordance with this preferred embodiment, first end 33 generally comprises a male end having a shoulder 34 and shaped section 32 configured to facilitate coupling to component part 29. Shoulder 34 is defined by the surface at which body section 12 transitions to first end 33 (in particular, shaped section 32). Preferably, section 32 is hex-shaped and has a uniform outer dimension, e.g., a point-to-point distance. In accordance with a preferred embodiment of the present invention, the uniform outer dimension of section 32 varies from 0.800" and 0.830", and most preferably varies between 0.817" and 0.818". Moreover, in accordance with a most preferred embodiment, the uniform outer dimension of section 32 is tapered to facilitate a tighter coupling to component part. Further, in accordance with the present invention, section 32 is configured such that it is symmetrical about its longitudinal axis and can thus be coupled to component part 29 in various rotational alignments. For example, in a typical single keyway alignment, only one rotational alignment is generally available. However, in accordance with the present invention, in a preferred hexed alignment, at least six configurations of rotational alignment are available. In accordance with the present invention, section 32 generally ranges in length from 1" to 1½", and preferably is 1¼" in length. Meanwhile, second end 15 generally comprises a bit seat. Bit seat 15 generally has a section 14 (preferably hex-shaped) and a button clip hole 20 and a button clip flat 22 configured for attachment of a button clip 24 to facilitate coupling of bit seat 15 to a drill bit 26. In accordance with the present invention, bit seat 15 is suitably configured for coupling to an internal vacuum suction bit used within the mining industry. Preferably, bit seat 15 ranges in length from ¾" to ⅞", most preferably 13⁄16". In accordance with the present invention, second end 15 typically has a uniform outer dimension ranging in length from 0.600" to 0.650" and most preferably from 0.618" to 0.622", although this range can be varied without departing from the scope of the invention.

Continuing in accordance with this preferred embodiment, component part 29 generally comprises a drive component including a collar portion 30 and an adapter portion 31. Collar portion 30 is configured to abut shoulder 34 when coupling drive component 29 to male end 33 while adapter portion 31 is configured to facilitate coupling of drive component part 29, and thus starter 10, with the drive chuck of a drilling machine (not shown). In accordance with the present invention, collar portion 30 and adapter portion 31 may be integrally formed. Alternatively, collar portion 30 may be a separate component and adapter portion 31 may be a separate component without departing from the scope of the present invention. Moreover, drive component part 29 includes an aperture 37 (shown in FIG. 3A by dashes) that is generally configured for coupling to hex-shaped section 32. Preferably, aperture 37 is also internally hex-shaped and generally includes a uniform inner dimension. In accordance with the present invention, the uniform inner dimension of aperture 37 preferably varies in length from 0.800" to 0.875", and most preferably from 0.817" to 0.819", although this range can be varied without departing from the scope of the invention. Further, as one skilled in the art will appreciate, aperture 37 and section 32 can be configured in various other shapes, such as, for example, triangles, rectangles, octagons and/or the like without departing from the scope of the present invention.

In accordance with a preferred exemplary embodiment of the present invention, the uniform inner dimension of drive component 29, as defined by aperture 37, is smaller than the uniform outer dimension of section 32. In accordance with another preferred aspect, the uniform outer dimension of section 32 is tapered to facilitate a secure press-fit coupling of drive component 29 to male end 33. Typically, in accordance with the present invention, uniform outside dimension of section 32 is machined, with momentary reference to FIG. 9, such that the dimension ranges from 0.800" to 0.875", and most preferably from 0.817" to 0.818", although this range can be varied without departing from the scope of the present invention. With reference to FIG. 1B, section 32 may be tapered, for example, such that an outer dimension 35 is 0.817" and an outer dimension at shoulder 34 is 0.819". When coupled to a drive component having a uniform inner dimension of 0.817", the tapering of section 32 facilitates a tighter press-fitting than without the tapering.

Continuing in accordance with a particularly preferred embodiment, male end 33 further comprises a recessed portion 36 configured to receive and seat a safety ring 40, described in further detail below, to provide a more effective coupling between component part 29 and body section 12. Alternatively, male end 33 can be of a uniform outer dimension without recessed portion 36 and yet still be effectively coupled to drive component 29 in accordance with the present invention.

The preferred embodiment of starter 10 above is utilized as a "hands-on" starter in which a drill operator generally inserts starter 10 into the drilling machine and operates the drill while the operator's hands are guiding the drive component part 29 and/or body 12. Many states require mining operations to utilize a starter with a different configuration of component part 29, known as a "hands-off" starter, described below. Typically this requirement occurs when a 24" (or longer) drill is utilized.

Figure 2A:
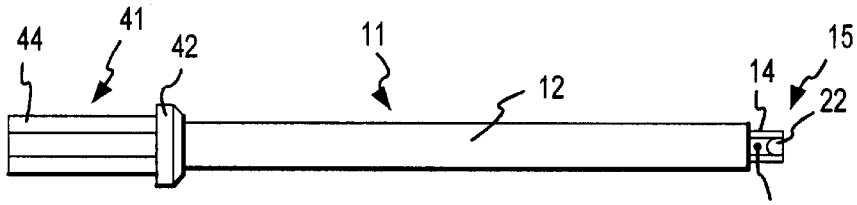
FIG. 2A is a side view of another embodiment of a starter member in accordance with the present invention.
Figure 2B:
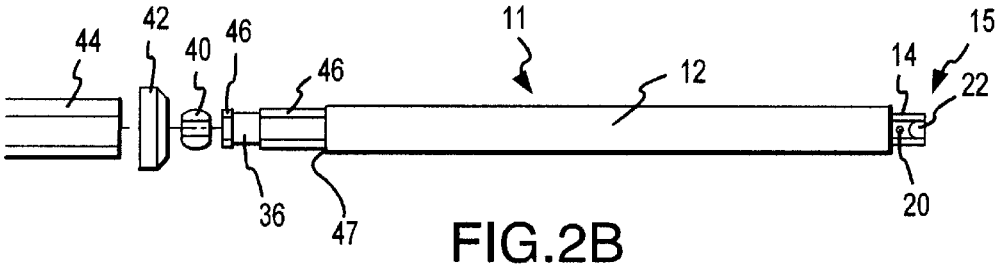
FIG. 2B is an exploded view of the exemplary embodiment shown in FIG. 2A.

In accordance with this particular embodiment, and with reference to FIGS. 2A and 2B, "hands-off" starter 11 comprises body 12 (as described above in connection with FIG. 1), a first end 45, and bit seat 15 (as described above). Moreover, first end 45 comprises a male end 210 having a section 46, preferably hex-shaped, and a shoulder 47. Preferably, section 46 is configured with a length longer than section 32 of starter 10 above to facilitate coupling to a drive component part 41. In accordance with the present invention, section 46 varies in length from 2" to 4", and most preferably is approximately 3" in length. Drive component part 41 generally comprises a collar 42, approximately ½" in length, configured to abut shoulder 47 when coupling drive component 41 to male end 45. Further, drive component part 41 comprises a coupling section 44, typically varying in length from 2" to 4½", configured for coupling directly to the drive chuck of a drill machine. In accordance with the present invention, collar 42 and coupling section 44 may be integrally formed. Alternatively, collar 42 may be a separate component and coupling section may be a separate component without departing from the present invention. Moreover, drive component part 41 includes an aperture 37 suitably configured for coupling to male end 45, with or without the assistance of recessed portion 36 and safety ring 40 (not shown). Accordingly, aperture 37 preferably comprises a shape to facilitate coupling with the shape of section 46, such as a hex-shape. Moreover, as described above with starter 10, in accordance with a preferred embodiment of the present invention, an inner uniform dimension of aperture 37 may be smaller than an outer uniform dimension of section 46 to facilitate a tighter and more effective coupling of component parts. In accordance with a most preferred embodiment, section 46 may be tapered, as discussed above with section 32, to facilitate an even tighter coupling of component parts.

The aforementioned starters 10 and 11 may be utilized by drilling operators to begin the drilling process. Once the hole has been initially drilled, operators can replace starters 10 and 11 with other drill steel members described in further detail below.

Figure 3A:
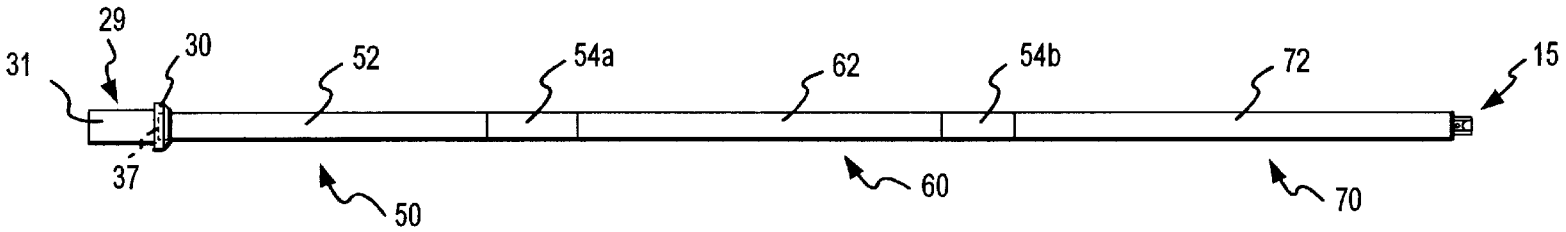
FIG. 3A is a side view of an exemplary embodiment of a combination of drill steel members in accordance with the present invention.
Figure 3B:
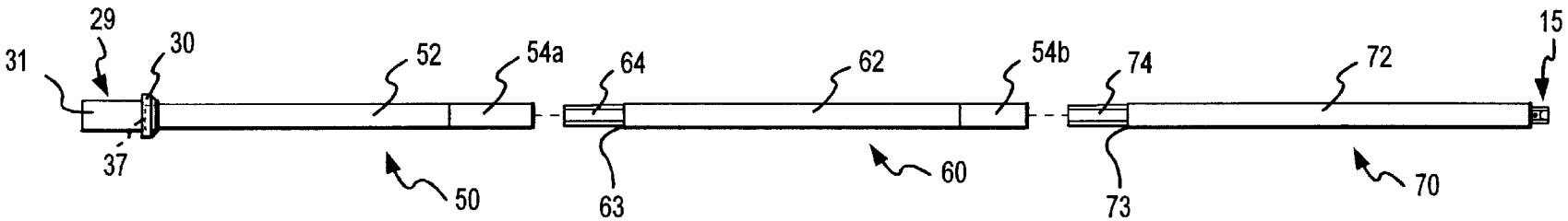
FIG. 3B is an exploded view of the exemplary embodiment shown in FIG. 3A.

With reference now to FIGS. 3A and 3B, in accordance with the present invention, alternative drill steel members may include a driver 50, an extension 60, and a finisher 70. FIG. 3A shows a preferred exemplary embodiment wherein driver 50, extension 60 and finisher 70 are coupled together in combination to facilitate drilling of the rock strata to depths further than what is generally attainable by the use of a single starter 10 or 11. As one skilled in the art will appreciate, in accordance with the present invention, drill steel members may include various other combinations of members including only driver 50 and finisher 70, or alternatively, driver 50, a plurality of extensions 60, and finisher 70 to effectively drill the desired depths of holes within the rock strata. In accordance with the present invention, the various configurations suitably include various component parts, such as drive component part 29 and female components 54 to removably couple drill steel members 50, 60 and 70 to one another.

Figure 4:
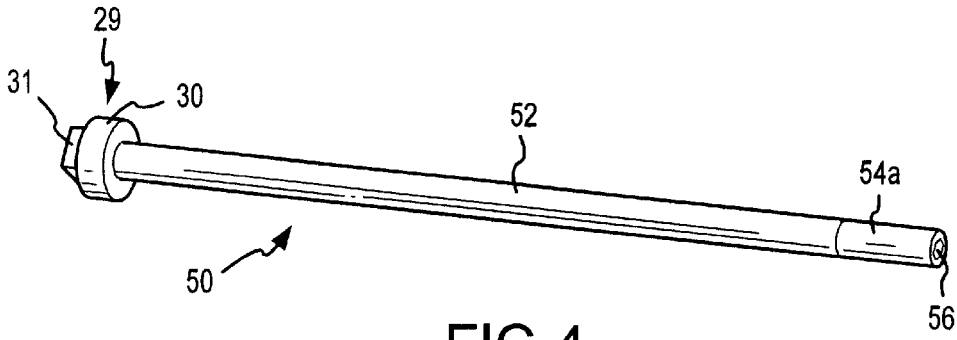
FIG. 4 is a perspective view of an exemplary embodiment of a driver member in accordance with the present invention.
Figure 5:
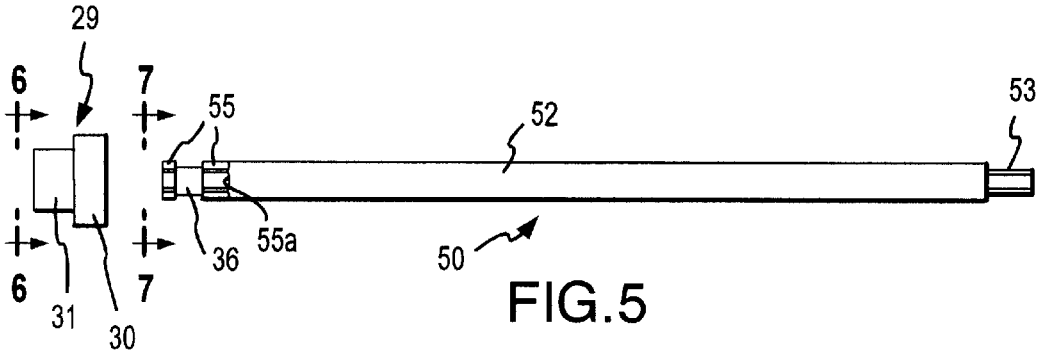
FIG. 5 is an exploded view of the exemplary embodiment shown in FIG. 4.

With reference now to FIGS. 4 and 5, in accordance with a preferred exemplary embodiment, driver 50 will be described in greater detail. In accordance with this embodiment, driver 50 suitably includes a body 52 preferably comprising a hollow steel tube, a first end 57 and a second end 53, a drive component 29 and a female component 54. In accordance with this preferred embodiment, first end 57 generally comprises a male end having a section 55, preferably hex-shaped. Further, male end 57 may include various shoulder portions 55*a* to provide a stop for drive component 29 when coupling to male end 57. Moreover, in accordance with a particularly preferred aspect, male end 57 may suitably include a recessed portion 36 configured for attachment of a safety ring 40 (see FIG. 8). Preferably, recessed portion is machined to a diameter ranging from 0.700" to 0.750", and most preferably from 0.738" to 0.742". In accordance with the present invention, male end 57 varies in length from 1" to 1½", and most preferably is 1¼" in length.

Figure 8A:
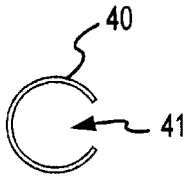
FIG. 8A is a side view of a preferred embodiment of a safety ring in accordance with the present invention.
Figure 8B:
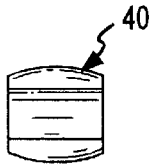
FIG. 8B is a front view of the safety ring shown in FIG. 8A.

In accordance with this preferred embodiment, and with momentary reference to FIG. 8A and 8B, safety ring 40 is preferably comprised of a percussion ring or the like configured to wrap around recessed portion 36 to facilitate a tighter and more secured coupling of male end 57 to drive component 29. Typically, safety ring 40 can generate an increase in pressure that is exerted upon an inner uniform dimension of drive component 29. Alternatively, with reference to FIG. 9, male end 57 may be suitably configured without recessed portion 36 and safety ring 40 when coupling to drive component 29.

Figure 6:
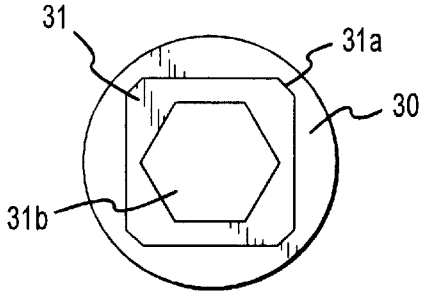
FIG. 6 is an end view of the driver member of FIG. 5 taken along the lines 6—6 of FIG. 5.
Figure 7:
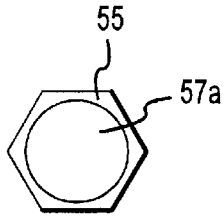
FIG. 7 is an end view of the driver member of FIG. 5 taken along the lines 7—7 of FIG. 5.

In accordance with a preferred exemplary embodiment of the present invention, drive component 29 comprises a collar portion 29 and an adapter portion 31. Collar portion 30 is configured to adjoin shoulders 55*a* while adapter portion 31 is configured to facilitate coupling of drive component part 29, and thus driver 50, to the drive chuck of a drilling machine. In accordance with this aspect, with momentary reference to FIGS. 6 and 7, adapter portion 31 is configured for attachment to standard chuck drives, such as a square-like arrangement (for use as a "hands-on" driver), while drive component 29 is configured with an aperture 31*b* shaped in a manner, such as a hex-shape, to correspond to an outer uniform dimension 55 of first end 57. In accordance with a preferred aspect of the present embodiment, the inner uniform dimension of male end 57 is slightly larger than the inner uniform dimension of drive component 29 to facilitate a tighter coupling of components. Further, in accordance with the present invention, drive component 29 varies in length from 1¼" to 1¾", and most preferably is 1½" in length.

Although not described in detail, as one skilled in the art will appreciate, drive component 29 may also be suitably configured as a "hands-off" component, as previously described in FIG. 2. In accordance with this aspect of the present invention, starter 50 comprises a male end having a section 46 and a drive component 41 having an adapter portion 44 (as shown in FIG. 2B).

In accordance with the present invention, second end 53 generally comprises a male end configured for coupling to female component 54 to facilitate attachment of driver 50 to extension 60 or finisher 70. Preferably, male end 53 is configured with an outer uniform dimension of a hex-shape. Additionally, male end 53 preferably varies in length from ¾" to 1¼", and is most preferably 1" in length. In accordance with the present invention, male end 53 preferably has a uniform outer dimension which varies between 0.600" and 0.650", and most preferably between 0.632" and 0.633".

In accordance with the present invention, female component 54 has an aperture 56 for coupling to a corresponding male end 53 and to another drill steel member. Aperture 56 is preferably shaped in a manner to correspond to the outer uniform dimension of male end 53, such as, for example, a hex-shape. Additionally, female component 54 preferably varies in length from 2¼" to 2¾", and is most preferably 2½" in length. Further, as described above with respect to the other similar components, the respective inner and outer dimensions of female component 54 and male end 53 are configured such that a tighter fit is realized upon coupling of the components together.

Figure 10A:
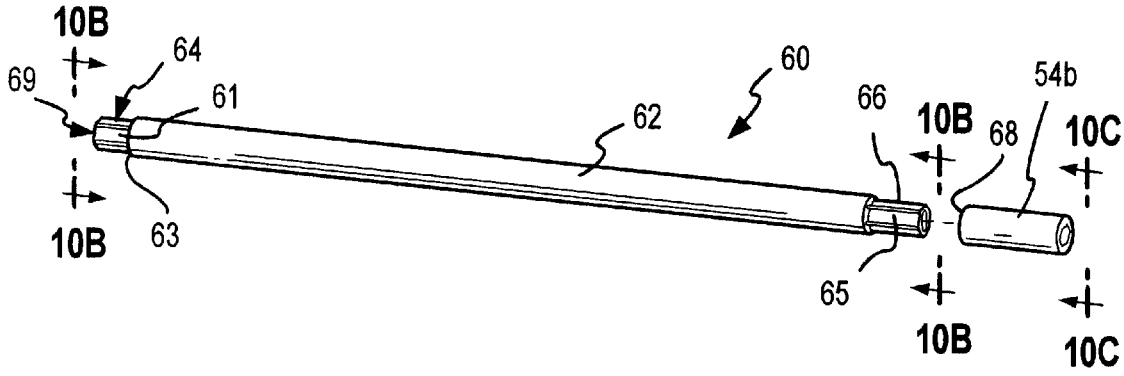
FIG. 10A is an exploded perspective view of an exemplary embodiment of an extension member in accordance with the present invention.
Figure 10B:
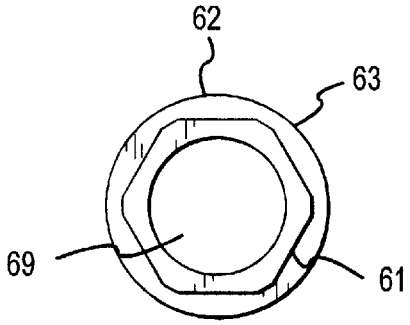
FIG. 10B is an end view of the extension member of FIG. 10A taken along the lines 10B—10B of FIG. 10A.
Figure 10C:
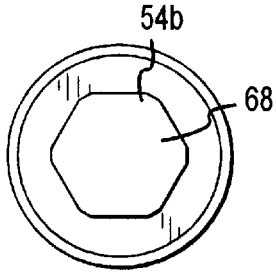
FIG. 10C is an end view of the extension member of FIG. 10A taken along the lines 10C—10C of FIG. 10A.
Figure 11A:
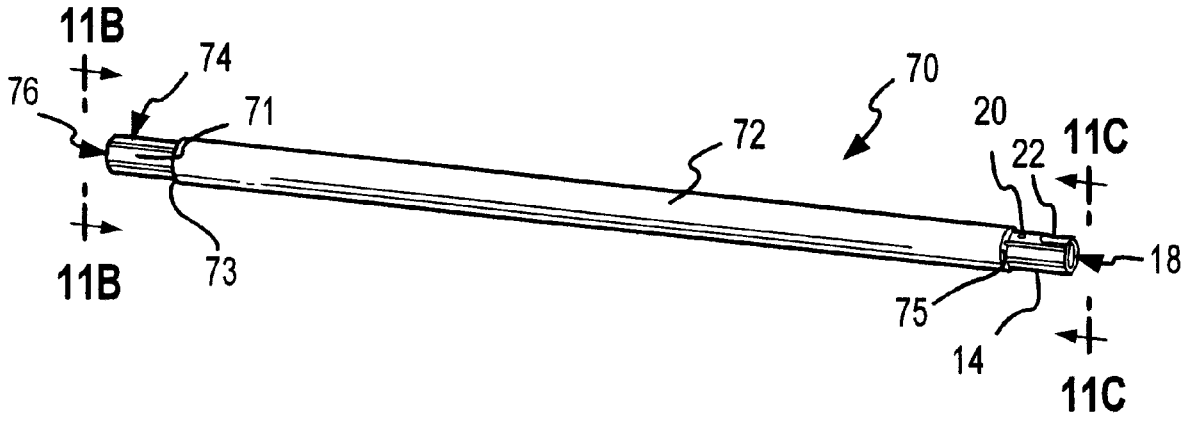
FIG. 11A is an perspective view of an exemplary embodiment of a finisher member in accordance with the present invention.
Figure 11B:
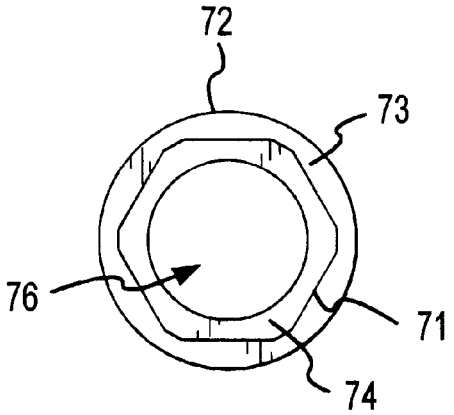
FIG. 11B is an end view of the finisher member of FIG. 11A taken along the lines 11B—11B of FIG. 11A.
Figure 11C:
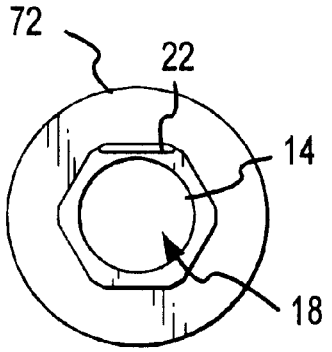
FIG. 11C is an end view of the finisher member of FIG. 11A taken along the lines 11C—11C of FIG. 11A.
Figure 12A:
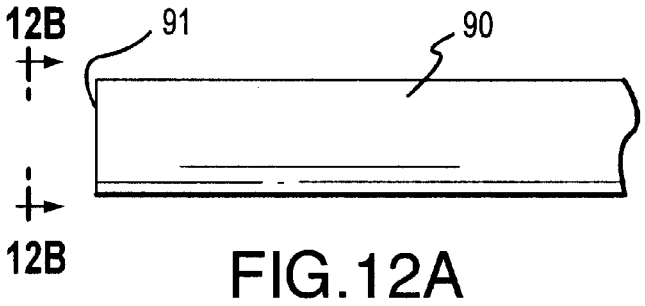
FIG. 12A is a side view of a typical unfinished drill steel section in accordance with the present invention.
Figure 13A:
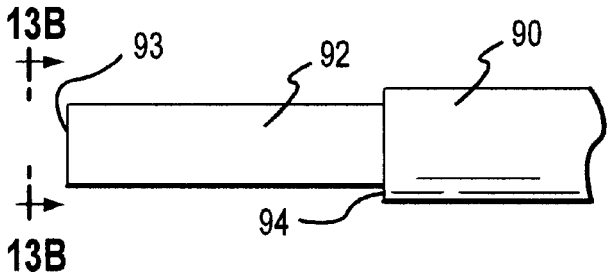
FIG. 13A is a side view of a drill steel section after turning down a portion and cropping off the end in accordance with the present invention.
Figure 12B:
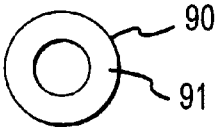
FIG. 12B is an end view of the drill steel section of FIG. 12A taken along the lines 12B—12B of FIG. 12A.
Figure 13B:
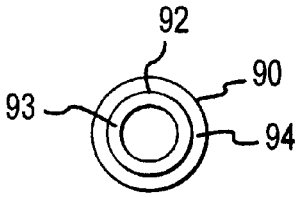
FIG. 13B is an end view of the drill steel section of FIG. 13A taken along the lines 13B—13B of FIG. 13A.

With reference now to FIG. 10A, in accordance with a preferred exemplary embodiment, extension 60 will now be described in greater detail. In accordance with this embodiment, extension 60 suitably includes a body 62 preferably comprising a hollow steel tube, a first end 64, a second end 66, and a female component 54*b*. In accordance with this preferred embodiment, and with momentary reference to FIG. 10B, first end 64 generally comprises a male end having a section 61, preferably hex-shaped, and a shoulder 63. Preferably, male end 64 is configured for removably coupling to aperture 56 of female coupling 54. This aspect of the present invention facilitates a quick, removable coupling of extension 60 to driver 50 or, alternatively, to another extension 60. In accordance with the present invention, male end 64 varies in length from 1" to 1½", and is most preferably 1 13/16" in length. In accordance with the present invention, male end 64 preferably has a uniform outer dimension which varies between 0.600" and 0.650", and most preferably between 0.618" and 0.622". Further, second end 66 includes an uniform outer dimension 65, preferably a hex-shaped section, and a shoulder 63, similar to first end 64. In accordance with the present invention, male end 66 varies in length from ¾" to 1¼", and is most preferably 1" in length. In accordance with the present invention, male end 66 is similar in dimensions to male end 53 as described in FIG. 5 above. Female component 54*b* suitably includes an aperture 68 shaped in a manner to facilitate coupling to uniform outer dimension 65 of second end 66. Preferably, aperture 68 is also hex-shaped. In accordance the present invention, female component 54*b* varies in length from 2¼" to 2¾", and is most preferably 2½" in length. In accordance with the present invention, the uniform inner dimension of female component 54*b* varies in length between 0.620" and 0.650", and most preferably between 0.632" and 0.633". Additionally, as described above with respect to the other similar components, the respective inner and outer dimensions of female component 54 and male end 66 are configured such that a tighter fit is realized upon coupling of the components together With reference now to FIG. 11A, in accordance with a preferred exemplary embodiment, finisher 70 will now be described in greater detail. In accordance with this embodiment, finisher 70 suitably includes a body 72 generally comprising a hollow steel tube, a first end 74 and a second end 75. In accordance with this preferred embodiment, and with momentary reference to FIG. 11B, first end 74 generally comprises a male end having a section 71, preferably hex-shaped, and a shoulder 73. Preferably, male end 74 is configured for removably coupling to aperture 56 of female coupling 54. This aspect of the present invention facilitates a quick removable coupling of finisher 70 directly to driver 50 or, alternatively, to extension 60. In accordance with the present invention, male end 74 varies in length from 1" to 1½", and is most preferably 1¼" in length. In accordance with a preferred embodiment of the present invention, male end 74 has a uniform outer dimension similar to male end 64 as described in conjunction with FIG. 11A.

In accordance with this preferred embodiment, with momentary reference to FIG. 8B, second end 75 comprises a bit seat. Preferably, bit seat 75 has a hexed-shaped section 14, and a button clip hole 20 and a button clip flat 22 configured for attachment of a button clip 24 to further facilitate coupling of bit seat 15 to a drill bit 26.

Having described various preferred exemplary embodiments of drill steel members, such as starters 10, drivers 50, extensions 60 and finishers 70, methods for manufacturing drill steel members will now be described in more detail. Drill steel members generally include first and second ends suitably configured as male ends or bit seats for coupling to various component parts, such as drive components, female components and carbide drill bits.

With reference now to FIGS. 12A–14B, in accordance with a preferred exemplary embodiment, methods for manufacturing male ends generally begin with the provision of a tube steel section having a desired length and having a uniform outside diameter 90 throughout its length. Additionally, tube steel sections generally have an uneven edge 91. Next, the tube steel section is machined down, or turned down, to a smaller outside diameter section 92 while uneven edge 91 is preferably cropped off to suitably provide an even edge 93, e.g., a level end more suitable for coupling. In accordance with the preferred embodiment of the present invention, section 92 is preferably turned downed to a diameter ranging from 0.650" to 0.700", and most preferably from 0.684" to 0.687". The turning down of the tube steel section also produces a shoulder 94 which suitably provides a stopping point for the various components when being coupled to the finished male ends. After turning down, smaller outside diameter section 92 is machined to a new shape to facilitate coupling to component parts such as the female component and the drive component.

Figure 14B:
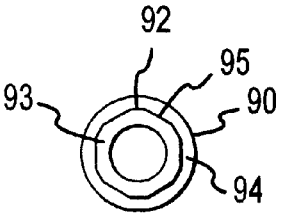
FIG. 14B is an end view of the male end component of FIG. 14A taken along the lines 14B—14B of FIG. 14A.
Figure 14A:
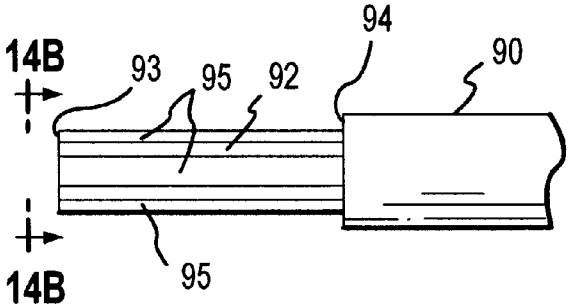
FIG. 14A is a side view of a preferred embodiment of a male end component in accordance with the present invention.

In accordance with the preferred embodiment of the present invention, with reference to FIG. 14B, outside diameter section 92 is configured to a hex-shaped portion 95 to facilitate coupling to component parts. Preferably, the hexing of portion 95 is formed by milling a portion of section 92 to a flat surface 95, slightly rotating section 92 within a milling machine (not shown) and milling a second portion of section 92 to a flat surface 95, and continuing this process until section 92 is configured to a hex-shape. In accordance with a most preferred embodiment of the present invention, the milling machine includes a locking device for maintaining position of section 92 when milling a flat surface 95 and a rotator device to facilitate an appropriate amount of rotation to continue the hexing of section 92. As a result of the hexing process, in accordance with the present invention, in general, male ends are configured such that section 92 is symmetrical about its longitudinal axis and can thus be coupled to component parts, such as female components and drive components, in various rotational alignments. For example, in a typical single keyway alignment, only one rotational alignment is generally available. However, in accordance with the present invention, in a preferred hexed alignment, at least six configurations of rotational alignment are available for male ends.

Figure 15:
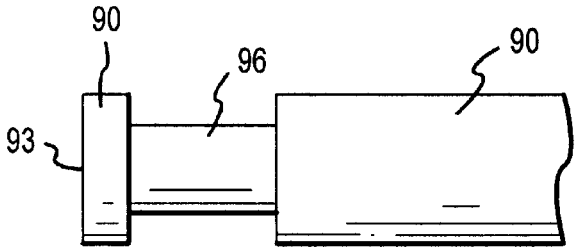
FIG. 15 is a side view of a drill steel section after turning down a portion for a safety ring and cropping off the end in accordance with the present invention.
Figure 16B:
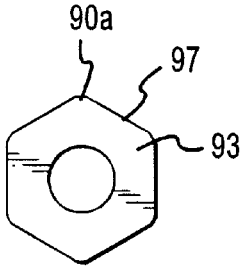
FIG. 16B is an end view of the male end component of FIG. 16A taken along the lines 16B—16B of FIG. 16A.
Figure 16A:
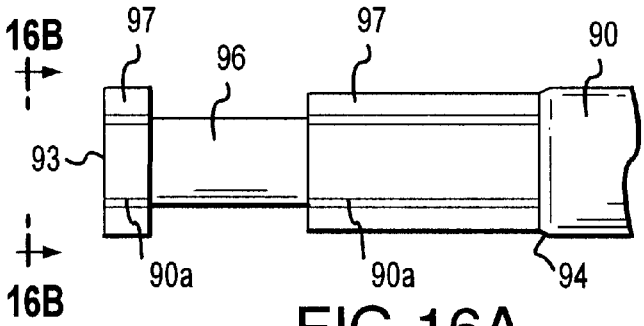
FIG. 16A is a side view of another preferred embodiment of a male end component in accordance with the present invention.

With reference now to FIGS. 15 through 16, methods for manufacturing male ends having recessed portions configured for attachment of a safety ring will now be described. These methods are generally performed on a tube steel section having a desired length and having a uniform outside diameter 90 throughout its length. Additionally, tube steel sections typically have an uneven edge 91. Next, a portion of the tube steel section is turned down to a recessed portion 96 while uneven edge 91 is cropped off to suitably provide an even edge 93. After turning down of a portion of section 90 to produce recessed portion 96, outside diameter section 90 is machined to a new shape to facilitate coupling to component parts such as the female component and the drive component. In accordance with the preferred embodiment of the present invention, with reference to FIGS. 16A and 16B, outside diameter section 90 is configured to a hex-shaped portion 97, as described above, to facilitate coupling to component parts.

Figure 9:
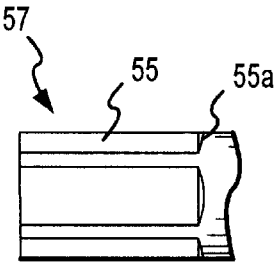
FIG. 9 is a side view of an alternative preferred embodiment of a male end used with a drill steel member in accordance with the present invention.

It should be noted that the male ends shown in FIGS. 15 and 16 may be initially turned down to a smaller diameter prior to the formation of recessed portion 96. Further, the recessed portion 96 may be formed after hex-shaped portion 97 is formed. In other words, the various machining steps described herein need not always be performed in the recited order. Further, it should be noted that male ends shown in FIGS. 12 through 19 may be formed without turning down before hexing. In other words, male ends may be directly hexed by the machining methods describe above to various dimensions directly from the original outer diameter 90 of the steel tube section, as is shown in FIG. 9.

Figure 17:
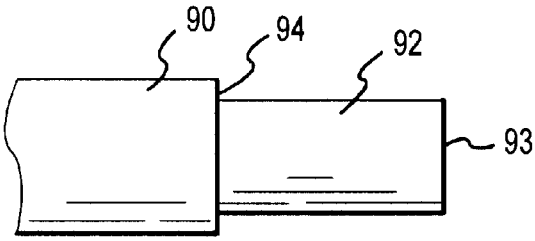
FIG. 17 is a side view of a drill steel section after turning down a portion and cropping off the end in accordance with the present invention.
Figure 18:
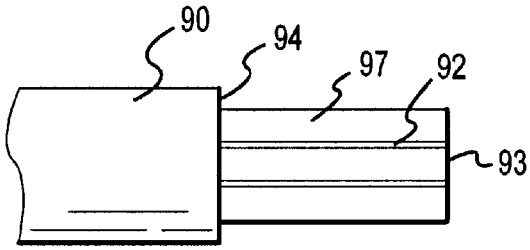
FIG. 18 is a side view of another preferred embodiment of a male end component in accordance with the present invention.
Figure 19A:
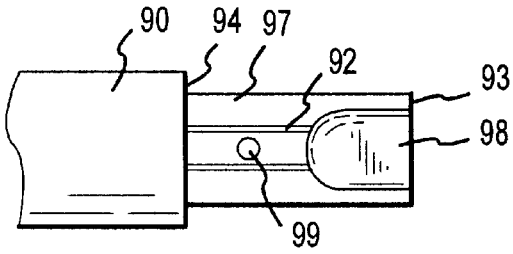
FIG. 19A is a top view of the preferred embodiment of the male end component shown in FIG. 18 after machining a button clip hole and a button clip flat in accordance with the present invention.
Figure 19B:
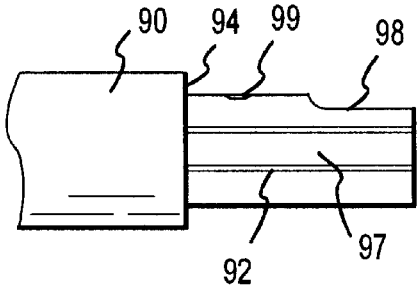
FIG. 19B is a side view of the male end component shown in FIG. 19A in accordance with the present invention.

With reference now to FIGS. 17–19, in accordance with a preferred exemplary embodiment, methods for manufacturing male ends configured as bit seats generally start with a tube steel section having a desired length and having a uniform outside diameter 90 throughout its length. Additionally, tube steel sections generally have an uneven edge 91. Next, with reference to FIG. 17, the tube steel section is turned down to a smaller outside diameter section 92 while uneven edge 91 is cropped off to suitably provide an even edge 93. The turning down of the tube steel section also produces a shoulder 94 which suitably provides a stopping point for the drill bits when being coupled to the bit seat. After turning down, with reference to FIG. 18, smaller outside diameter section 92 is machined to a new shape to facilitate coupling to the internal aperture of drill bits. In accordance with the preferred embodiment of the present invention, outside diameter section 92 is configured to a hex-shaped portion 97, as described above, to facilitate coupling to the drill bits. Next, with reference to FIGS. 19A and 19B, an end portion of outside diameter section 92 and hex-shaped portion 97 are milled down to provide flat portion 98 configured for a button clip 24 (as shown in FIG. 1B). Preferably flat portion 98 is milled down between 0.025" and 0.035", most preferably to 0.030". The bit seat is completed upon the drilling of a hole 99 configured for receiving a button clip portion 16 (also as shown in FIG. 1B). Alternatively, hole 99 may be drilled initially and then followed by the milling of flat portion 98.

The above described preferred exemplary methods (as shown in FIGS. 12–19) for manufacturing various configurations of male end components are accomplished without the use of heat such as is used by known welding and forging methods. In accordance with the present invention, male ends are normally at moderate temperatures during machining (generally less than 200 degrees Fahrenheit, and more typically between 40 degrees and 120 degrees Fahrenheit). Further, in a particularly preferred embodiment of the present invention, various cooling systems are utilized to preventing the heating of steel as it is processed during milling operations. In a most preferred embodiment, various coolants may be sprayed onto the male ends during machining such that after a male end is machined, an operator may touch the machined part with their hands. In accordance with this aspect, the temperature of male ends ranges between 40–120 degrees Fahrenheit.

The above described preferred exemplary methods for manufacturing various configurations of male end components can be applied to the drill steel members shown in FIGS. 1 through 11 to facilitate coupling to the various configurations of female and drive components to suitably provide starters 10 and 1, drivers 50, extensions 60 and finishers 70. For example, with reference to FIG. 1B, starter 10 includes a male end 33 having a recessed portion 36 preferably manufactured by the method described above in connection with FIGS. 15 through 16B. Moreover, starter 10 includes a bit seat 15, preferably manufactured in accordance with the method described in FIGS. 17 through 19B.

As one skilled in the art will appreciate, the order of the manufacturing steps described above can be changed in various manners. For example, in manufacturing starter 10, one can first manufacture male end 33 and then manufacture bit seat 15; alternatively, bit seat 15 can first be manufactured and then male end 33 can be machined. Still further, first end 33 and second end 15 can each be turned down to smaller diameters and then hexed to facilitate coupling to component parts.

As another example, with reference to FIG. 5 and driver 50, male end 57 having a recessed portion 36 can preferably be manufactured by the method described above in connection with FIGS. 15 through 16B. Moreover, male end 53 can preferably be manufactured in accordance with the method described in FIGS. 12A through 14A. Moreover, male end 57, with the recessed portion, can initially be manufactured and then male end 53 can be manufactured; alternatively, male end 53 can initially be manufactured and then male end 57. Still further, male end 57 and male end 53 can each be turned down to smaller diameters and then hexed to facilitate coupling to component parts. As one skilled in the art will appreciate, the order of manufacturing steps can be rearranged in virtually any manner without departing from the scope of the present invention. Further, one skilled in the art will appreciate that the flexibility described above with respect to the manufacturing steps for starters 10 and drivers 50 can also equally be applied to extensions 60 and finishers 70 without departing from the scope of the present invention.

Having described various method steps for manufacturing male ends utilized by the various drill steel members, additional method steps for coupling the various other component parts, such as female and drive components, will now be described in further detail.

In accordance with an exemplary embodiment of the present invention, with reference to FIGS. 4 and 5, various steps for coupling drive component 29 and female component 54*a* to drive member 50 will be described. Generally, before coupling drive component 29 to male end 57, safety ring 40 is placed around recessed portion 36 and then compressed to attach safety ring to male end 57. Next, with momentary reference to FIG. 6, male end 57 is inserted into aperture 31*b* of drive component 29. In accordance with the preferred embodiment, the outside uniform dimension of male end 57 is slightly larger than the inner outside dimension of drive component 29. Accordingly, to effectively couple drive component 29 to male end 57, a press-fitting operation is performed. Preferably, this process is initiated by slightly tapping or pounding drive component 29 onto male end 57 so that the components are initially set. This initial attachment allows the assembly to be handled and manipulated prior to the final press-fitting process.

In accordance with the present invention, as described above, in order to rigidly couple component parts such as drive components 29 and female components 54 to the drill steel members, a high pressure force is preferably applied. In accordance with a preferred embodiment of the present invention, with reference to FIG. 20, an apparatus 100 comprising a pressure-fitting device generally includes a housing 101, a ram 102 and a block 104. Housing 101 generally includes a backstop 108 and a plurality of stopping blocks 110 defining a passageway 112 useful for positioning a drill steel section and a plurality of channels 116 useful for positioning block 104 during operation of device 100. Preferably, stopping blocks 110 are configured in fixed increments of length and positioned so that drill steel members of varying drilling length may be press-fitted by device 100. In a most preferred embodiment of device 100, blocks 110 are positioned in 6" increments so that drill members of varying sizes, generally provided in drilling length increments of 6" in the current industry, can be readily manufactured. Moreover, backstop 108 and stopping blocks 110 have a surface 109 useful for maintaining position of block 104 within channels 116.

In accordance with a further aspect of this preferred embodiment, block 104 includes a protruding member 106 useful for insertion into an aperture of a component part, such as for example, female component 54. Further, ram 102 is configured to apply a pressure against a surface of a component part, such as, for example, a drive component 29, to press-fit components onto a male component. Preferably, ram 102 is a high-pressure hydraulic ram capable of applying up to 30 tons of force against a surface of a component part. During operation, ram 102 slidably traverses within housing 101 and applies a pressurized force against the component part surface.

In accordance with the preferred embodiment of the present invention, ram 102 suitably presses against adapter portion 31 within a desirable range of force. Generally, ram 102 is configured so that a minimum of 10 tons of force is applied by ram 102 while a maximum of 30 tons of force is possible. Preferably, the range of operation for ram 102 is between 10 tons and 20 tons. In accordance with the present invention, a pressure gauge may be utilized to further provide an indication of the amount of pressure needed to couple a component part to a drill steel section. In accordance with this aspect, corresponding pressure gauge readings should be determined for a given amount of force. For example, a particular press-fitting device 100 may provide a gauge reading of 1000 lbs. of pressure to correspond to 10 tons of force while a gauge reading of 6000 lbs. of pressure may correspond to 30 tons of force. Since a minimum of 10 tons of force and a maximum of 30 tons of force are typically desirable for coupling components to drill steel sections, in this example, a minimum gauge reading of 1000 lbs. and a maximum gauge reading of 6000 lbs. could be established as guidelines for providing the necessary amount of force to couple components. It has become apparent to the inventor that drill steel members press-fitted with below 10 tons of force or above 30 tons of force have a tendency to have a higher rate of failure; thus those members are preferably discarded or recycled into other sized drill steel members, if possible. The inventor has discovered that a low force observed during press-fitting is an indication that the difference between the outside uniform dimension of a male component and the internal dimension of an aperture of a female or drive component is below a minimum tolerance and thus the coupling of the components may not be as secure as desired. Accordingly, the inventor has discovered that the indication of a high force (30 tons or more) during press-fitting, for example in excess of 6000 lbs. as indicated on a pressure gauge for a particular press-fitting device 100, is an indication that the difference in respective dimensions of the male end and female or drive component is too large and that a forced coupling of the components can lead to premature failures due to residual stresses being created. Therefore, in accordance with the present invention it is more desirable that the force utilized during press-fitting fall within the range of 15 tons to 25 tons of force (or as shown by one example of a pressure gauge, between 2500 and 4500 lbs. of pressure).

Figure 20:
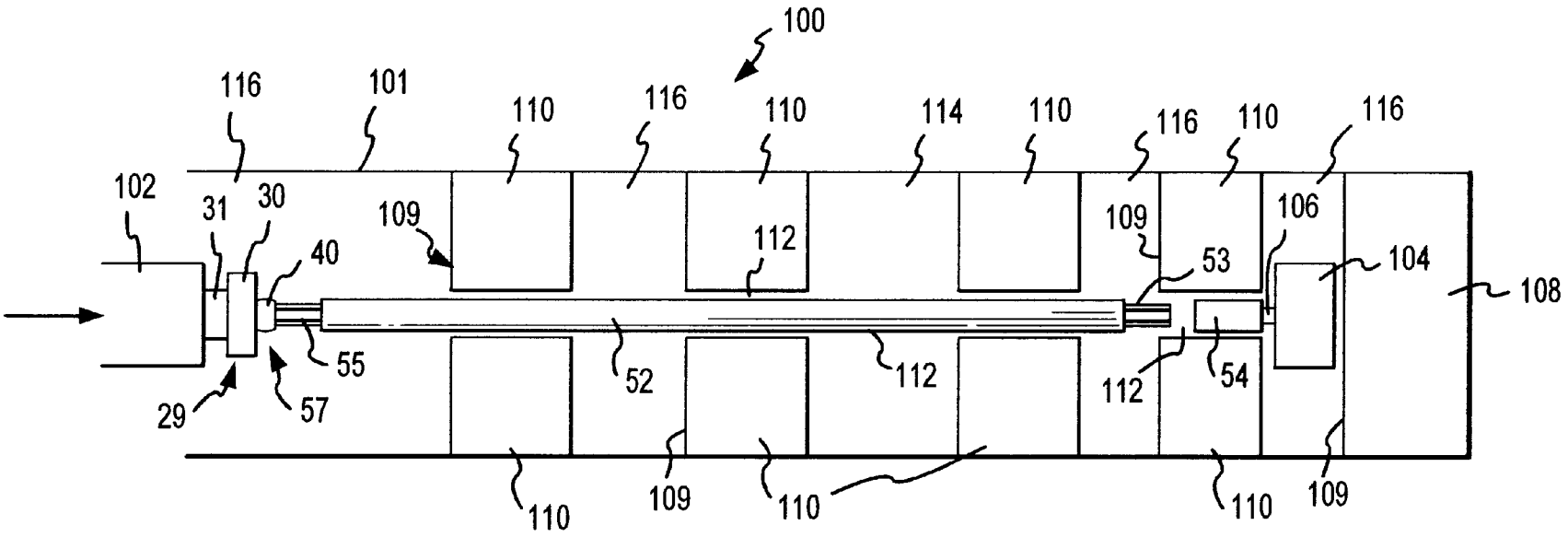
FIG. 20 is an exemplary embodiment of a press-fitting apparatus in accordance with the present invention.

Now that a preferred embodiment of an apparatus for applying a pressure-fitting engagement between component parts and drill steel sections has been described, a method for coupling components to drill steel sections will be described. With reference to FIG. 20, an example of the use of press-fitting device 100 to couple component parts for an exemplary embodiment of driver 50 generally includes the step of placing drive component 29 onto male end 55 and over safety ring 40, as described above. Additionally, protruding member 106 of block 104 is placed into one end of female component 54. Further, the other end of female component 54 is generally placed over male end 53 of driver 50. Preferably, female component 54 is lightly tapped onto male end 53 to initially press-fit the components together. Next, drive component 20, steel tube section 52, female component 54 and block 104 are placed within passageway 112 and channels 116 to facilitate application of a pressurized force by ram 102. Upon initiation, ram 102 slidably presses against adapter portion 31 while backstop 108 maintains the relative position of block 104. This press-fitting action results in the simultaneous press-fitting of component parts 29 and 54 onto respective male ends 57 and 53. As discussed above, to the extent that the force utilized for the press-fitting of the components falls within the range of 10 tons to 30 tons, then the manufacture of driver 50 will be completed.

As one skilled in the art will appreciate, the present invention is not limited to the use of device 100 for press-fitting components onto drill steel sections. Accordingly, any known press-fitting device now known or hereafter devised may be utilized for press-fitting the components to the drill steel members without departing from the scope of the present invention.

It should be noted that the coupling of the various component parts, such as the female and drive components, to the male ends is accomplished without the use of heat. In accordance with the present invention, the coupling of components occurs while the drill steel members and components are at moderate temperatures, e.g., between 40 and 120 degrees Farenheit. As one skilled in the art will appreciate, the manufacturing of drill steel members in the absence of externally applied heat will produce drill steel members with significantly less residual stresses and cracks than are currently produced by the prior art methods of welding and forging.

Although the subject invention is described herein in conjunction with the appended drawing figures, it will be appreciated that the invention is not limited to the specific form shown. Various modifications in the selection and arrangement of parts, components, and processing steps may be made in the implementation of the present invention. For example, although preferred embodiments are set forth in which exemplary manufacturing methods are utilized, it will be appreciated that various other embodiments of drill steel members, now known or hereafter devised, may be manufactured from the methods described above without departing from the scope of the present invention. Moreover, although illustrated ranges of values for the various preferred embodiments of the present invention were discussed, the ranges are not limiting and can be suitably configured for various other preferred ranges depending on various other factors, such as the steel grades, composition and hardness, the type of drilling machine utilized, the type of rock strata to be drilled and/or the like. These and other modifications may be made in the design and arrangement of the various components which implement the invention without departing from the spirit and scope of the invention as set forth in the appended claims.

What is claimed is:

1. A drill steel member for a roof drilling system used in the mining industry, said drill steel member comprising:

a body formed from a steel tube having a first uniform outer diameter;

a first machined end integral to said body, said first machined end being devoid of threads and having an external shape and a first outer dimension smaller than said first uniform outer diameter of said body; and wherein said first machined end further comprises:

a percussion ring comprising a semi-circular shape; and a recessed portion having a uniform outer dimension less than said first outer dimension of said first machined end, and configured for attachment by said percussion ring;

a component part comprising an aperture formed therein, said aperture having an internal shape corresponding to said external shape of said first machined end, said aperture having an inner uniform dimension less than said first outer dimension of said first end; and wherein said component part is coupled to said first machined end by a press-fitting engagement; and wherein said recessed portion and said percussion ring facilitate an increase in pressure against said inner uniform dimension of said component part to secure the coupling of said component part to said first machined end.

2. A drill steel member for a roof drilling system used in the mining industry, said drill steel member comprising a body formed from a steel tube having a first uniform outer diameter;

a first machined end integral to said body, said first machined end being devoid of threads and having an external shape and a first outer dimension smaller than said first uniform outer diameter of said body; and a component part comprising an aperture formed therein, said aperture having an internal shame corresponding to said external shape of said first machined end, said aperture having an inner uniform dimension less than said first outer dimension of said first end; and wherein said component part is coupled to said first machined end by a press-fitting engagement; and wherein said first outer dimension of said first machined end is tapered to facilitate the press-fitting arrangement.

3. A machined drill steel member for use with drilling machines; said drill still member comprising:

a steel tube having a substantially uniform outer diameter;

a first end being devoid of threads and having a machined first outer diameter smaller than said uniform outer diameter of said tube; said first outer diameter of said first end having a diameter between 0.800" and 0.875";

a component having a machined uniform inner diameter smaller than said first outer diameter of said first end; and wherein said component part is forcibly connected to said first end by compression to provide a securely coupled fitting.

4. A machined drill steel member for use with drilling machines; said drill still member comprising:

a steel tube having a substantially uniform outer diameter;

a first end being devoid of threads and having a machined first outer diameter smaller than said uniform outer diameter of said tube; said first outer diameter of said fist end having a diameter between 0.600" and 0.650";

a component having a machined uniform inner diameter smaller than said first outer diameter of said first end; and wherein said component part is forcibly connected to said first end by compression to provide a securely coupled fitting.

5. A machined drill steel member for use with drilling machines; said drill still member comprising:

a steel tube having a substantially uniform outer diameter;

a first end being devoid of threads and having a machined first outer diameter smaller than said uniform outer diameter of said tube; and a component having a machined uniform inner diameter smaller than said first outer diameter of said first end; and wherein said component part is forcibly connected to said first end by compression to provide a securely coupled fitting, and wherein said component part is forcibly connected to said first end by compression occurring in an ambient temperature of between 40 degrees and 120 degrees Fahrenheit.

6. A machined drill steel member for use with drilling machines; said drill still member comprising:

a steel tube having a substantially uniform outer diameter;

a first end being devoid of threads and having a machined first outer diameter smaller than said uniform outer diameter of said tube; and a component having a machined uniform inner diameter smaller than said first outer diameter of said first end; and wherein said component part is forcible connected to sa first end by compression to provide a securely coupled fitting, and wherein said component part is forcibly connected to said first end by a compression force between 15 tons and 25 tons.

* * * * *